US006656100B1

(12) United States Patent
Tseng

(10) Patent No.: US 6,656,100 B1
(45) Date of Patent: Dec. 2, 2003

(54) APPARATUS AND METHODS FOR FINISHING GRAPHIC CONTAINERS

(75) Inventor: Whah Tseng, Richmond (CA)

(73) Assignee: P. E. Printech Equipment, Inc., Richmond (CA)

( * ) Notice: Subject to any disclaimer, the term of this patent is extended or adjusted under 35 U.S.C. 154(b) by 0 days.

(21) Appl. No.: 09/668,626

(22) Filed: Sep. 22, 2000

(51) Int. Cl.[7] ..... B31B 9/00

(52) U.S. Cl. ..... 493/52; 493/62; 493/69; 493/71; 493/79; 493/131

(58) Field of Search ..... 493/52, 62, 68, 493/69, 70, 71, 72, 79, 80, 81, 93, 95, 96, 100, 110, 125, 126, 131

(56) References Cited

U.S. PATENT DOCUMENTS

| | | | | | |
|---|---|---|---|---|---|
| 1,402,259 | A | * | 1/1922 | Smith | |
| 1,745,385 | A | * | 2/1930 | Smith | |
| 2,215,011 | A | * | 9/1940 | McCoy et al. | |
| 5,462,223 | A | * | 10/1995 | Focke et al. | |
| 5,876,317 | A | * | 3/1999 | Sigrist et al. | 493/62 |
| 6,068,583 | A | * | 5/2000 | Sigl | 493/62 |
| 6,206,815 | B1 | * | 3/2001 | Focke et al. | 493/62 |

* cited by examiner

*Primary Examiner*—Eugene Kim
*Assistant Examiner*—Sameh Tawfik
(74) *Attorney, Agent, or Firm*—Perkins Coie LLP

(57) ABSTRACT

An integrated apparatus for forming folded containers comprising a film attaching unit, a fold/glue unit, and a common transport system coupling the film attaching unit to the fold/glue unit. The film attaching unit can have a pattern glue applicator for applying a pattern of glue to a blank and a film applicator operatively coupled to the pattern glue applicator to apply a film to the blank. The fold/glue unit is configured to receive the blank directly from the film attaching unit, and the fold/glue unit can have a plurality of fold-members for folding portions of the blank and at least one glue gun for applying glue to portions of the blank. The blank transport system can comprise a synchronized carrier to transport the blank through a portion of the film attaching unit and a plurality of non-synchronized carriers to transport the blank through the film attaching unit and/or the fold/glue unit without removing the blank from the transport system. In one embodiment, the synchronized carrier and the non-synchronized carriers are configurable in at least one of (a) a bypass configuration in which the blank bypasses the pattern glue applicator and the film applicator, (b) a pattern glue configuration in which the transport system is synchronized with the pattern glue applicator to apply the pattern of glue to the blank without applying a film, and/or (c) a film application configuration in which the transport system is synchronized with the pattern glue unit and the film applicator to attach a film to the blank.

3 Claims, 5 Drawing Sheets

APPARATUS AND METHODS FOR FINISHING GRAPHIC CONTAINERS

TECHNICAL FIELD

The present invention relates to finishing graphic containers. More specifically, several aspects of the invention are directed toward methods and apparatus for forming folded containers with or without thin film coverings.

BACKGROUND

Containers, such as cartons and boxes for a variety of uses, are generally made from paper products or other types of materials. The containers are typically folded and glued so that they can be shipped to a product manufacturer in a flat configuration and then expanded to receive a product. Several types of containers have openings covered by thin transparent films to create windows (e.g., toy containers) or access openings (e.g., tissue boxes), but other types of containers are solid and do not have thin transparent films. In either application, a container "blank" is formed from a sheet with graphics and/or text by stamping the sheet to (a) cut the sheet into a desired pattern and (b) form fold lines on the sheet. The blanks are then subject to a finishing process to attach a thin transparent film to window openings, apply glue to selected areas of the blank, and fold the blank into a finished container.

Conventional processes for finishing graphic containers with transparent films use a window patch machine for attaching the film to the blank and a separate fold/glue machine for folding and gluing flaps or panels of the blank. Conventional window patch machines have a feeder, a timed-chain carrier for transporting blanks from the feeder, a pattern glue applicator synchronized with the timed-chain carrier, and a film applicator synchronized with the pattern glue applicator. Conventional window patch machines are initially configured to accommodate a particular blank, and then all of the blanks for a particular container are processed through the window patch machine to attach the transparent film to the blanks. The blanks to which the transparent film patches have been attached are then stored at a separate location to await processing through the fold/glue machine.

The fold/glue machine typically has another feeder, a plurality of belt drives, a plurality of fold panels, and a plurality of glue guns. The fold/glue machine has a pre-folding section, a back-folding section, and a final-folding section that each have a different configuration of belt-drives, glue guns, and fold plates for folding and gluing the flaps and/or panels of the blanks. The conventional window patch machines and conventional fold/glue machines accordingly operate completely independent from one another because they are separate machines that use separate feeders and separate transport systems to feed and convey blanks through each of the machines.

One concern of finishing graphic containers with transparent films is that conventional processes require two runs to produce a single finished container. It is time-consuming to use two separate runs because the window patch machines and the fold/glue machines must be configured separately before running the blanks through the machines. After processing the blanks through the window patch machine, the blanks are also manually transported and loaded into a separate feeder for processing through the fold/glue machines. Additionally, if both the window patch machines and the fold/glue machines are operated simultaneously, conventional processes generally require two operators to configure and operate the two separate machines. Therefore, conventional processes for finishing graphic containers with separate window patch machines and fold/glue machines are time consuming and inefficient.

Another manufacturing concern of conventional processes for finishing graphic containers is that they require a significant amount of floor space. Because the window patch machines and the fold/glue machines are separate from one another, the blanks are stored in separate stacks to await processing the separate window patch and fold/glue machines. The window patch and fold/glue machines must also have individual feeders dedicated to each machine. As a result, a significant amount of floor space is occupied by the additional stacks of blanks and the duplicity of feeders for the separate window patch and fold/glue machines.

DETAILED DESCRIPTION

The following disclosure describes several embodiments of an integrated apparatus for forming folded containers. Many specific details of certain embodiments of the invention are set forth in the following description and in FIGS. 1–5 to provide a thorough understanding of these embodiments. A person skilled in the art, however, will understand that the present invention may have additional embodiments, or that the invention may be practiced without several of the details described below.

A. INTEGRATED CONTAINER FINISHING SYSTEMS WITH FILM ATTACHING UNITS AND FOLD/GLUE UNITS

Figure 1:
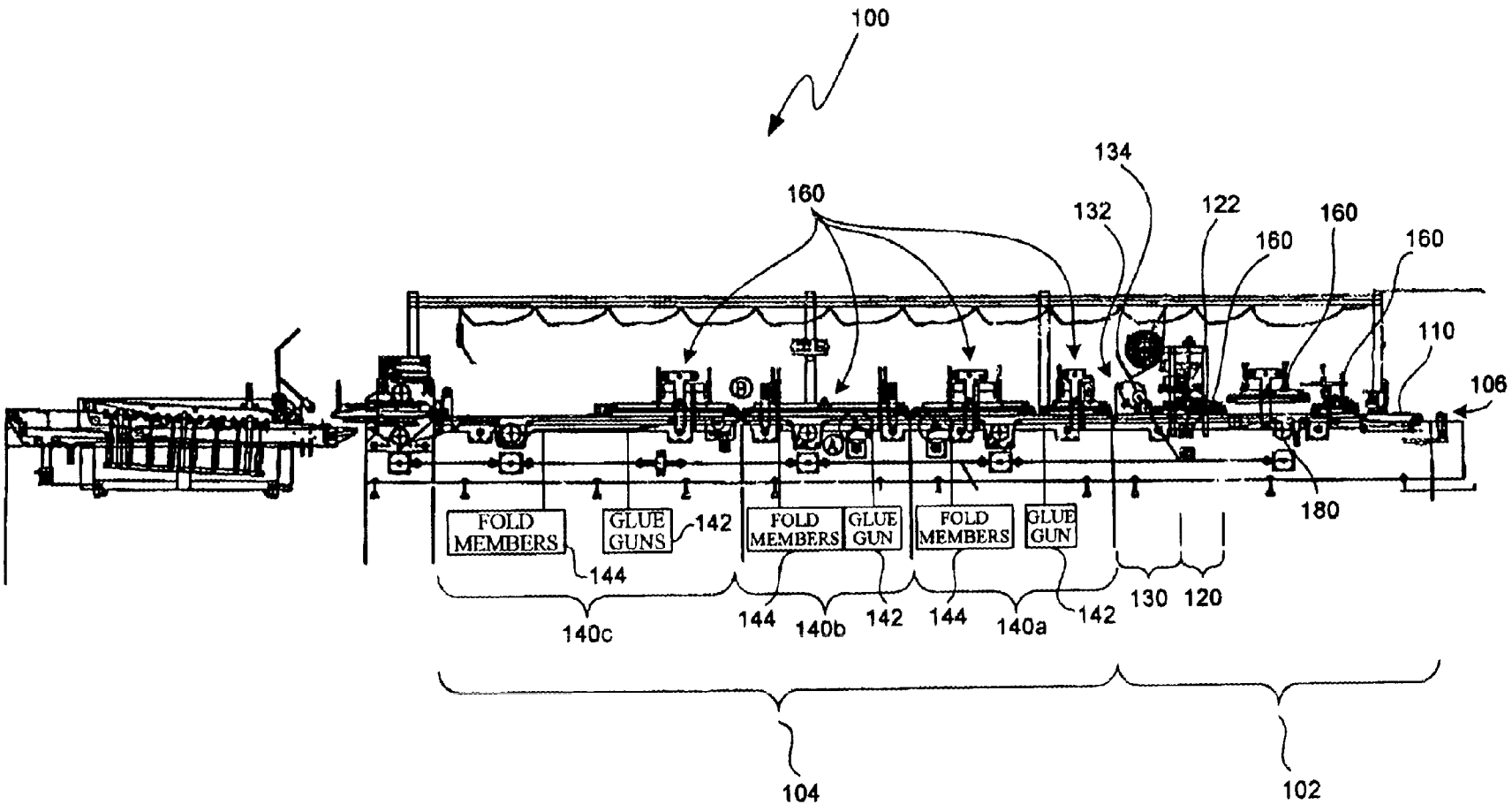
FIG. 1 is a side elevation view of an integrated apparatus for forming folded containers in accordance with an embodiment of the invention.
Figure 2:
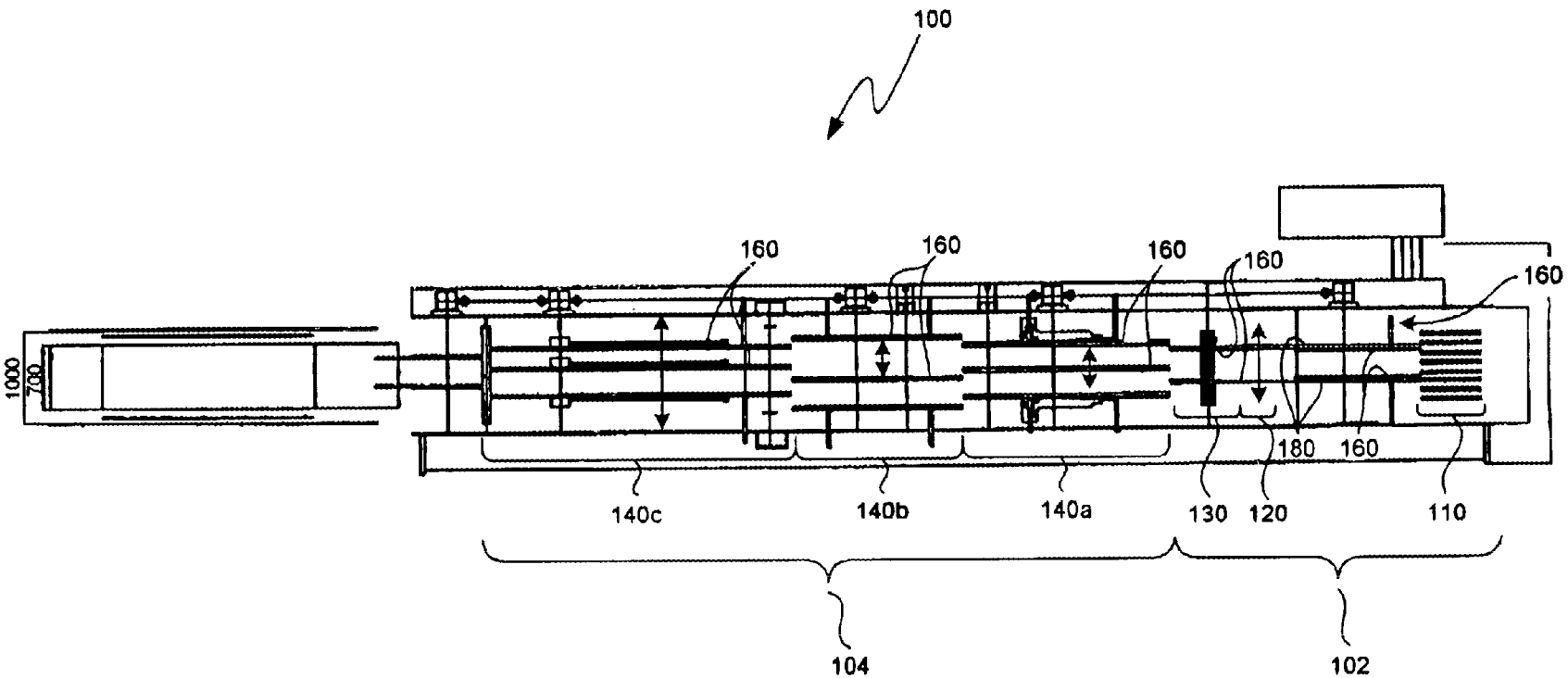
FIG. 2 is a top elevation view of the integrated apparatus of FIG. 1.

FIG. 1 is a side elevation view and FIG. 2 is a top plan view of an integrated apparatus 100 for forming folded containers in accordance with one embodiment of the invention. In this embodiment, the integrated apparatus 100 includes a film attaching unit 102, a fold/glue unit 104, and a transport system 106 extending through both the film attaching unit 102 and the fold/glue unit 104. The film attaching unit 102 can apply a pattern of glue around an opening of a blank and attach a patch of a thin film to the pattern of glue. The fold/glue unit 104 can receive a blank to which the film patch has been attached directly from the film attaching unit 102 to fold and glue the blank into a finished container. The transport system 106 is common to both the film attaching unit 102 and the fold/glue unit 104 to provide a single-pass operation in which a blank is transported directly from the film attaching unit 102 to the fold/glue unit 104.

Referring to FIG. 1, the film attaching unit 102 can include a feeder 110 at a feed end of the transport system

106, a pattern glue applicator 120 operatively coupled to one section of the transport system 106 for applying glue to a blank, and a film applicator 130 operatively coupled to another section of the transport system 106 downstream from the pattern glue applicator 120. The pattern glue applicator 120 can have a pattern wheel 122 with a glue surface (not shown in FIG. 1) configured in a desired pattern for applying a pattern of glue to a blank. In one embodiment for attaching a film patch to a blank to cover an opening, the pattern wheel 122 is synchronized with the transport system to apply a pattern of glue around the perimeter of the opening in the blank. The pattern glue applicator can alternatively have glue pens or guns that deposit glue in a manner similar to a dot-matrix printer or a jet printer. The embodiment of the film applicator 130 shown in FIG. 1 cuts and attaches a film patch to the blank. The film applicator 130 can also have several alternate embodiments. The film applicator 130, for example, can alternatively receive pre-cut film patches that it places on the blanks. In general, the film applicator 130 is synchronized with the pattern glue applicator 120 to accurately press a patch of film onto the pattern of glue. Suitable pattern glue applicators 120 and film applicators 130 are available from P. E. Printech Equipment Inc. of British Columbia, Canada.

The embodiment of the fold/glue unit 104 shown in FIG. 1 is configured to receive the blank directly from the film attaching unit 102. The fold/glue unit 104 can have several different sections for folding and gluing together different panels and flaps of the blank to form a container. In one embodiment, for example, the fold/glue unit 104 includes a prefolding section 140*a* that is one part of a backfolding section, a second folding section 140*b* that is another part of the backfolding section, and a final folding section 140*c*. It will be appreciated that the fold/glue unit 104 can have other combinations of sections or a different configuration of sections. Each of these sections can have a plurality of glue-guns 142 (shown schematically) and fold-members 144 (also shown schematically), such as hooks, fold-plates and air nozzles. The glue-guns 142 and fold-members 144 in the sections 140*a–c* of fold/glue unit 104 can be configured according to the particular container to fold, glue and attach flaps or panels of the blank to one another.

Still referring to FIG. 1, the transport system 106 couples the film attaching unit 102 to the fold/glue unit 104 so that the integrated apparatus 100 can (a) attach a film to the blank and/or (b) fold the blank into a finished container in a single-run operation. The transport system 106 can include a plurality of non-synchronized carriers 160 and a synchronized carrier 180. The non-synchronized carriers 160 and the synchronized carrier 180 can be configured to either pass a blank through the film attaching unit 102 without synchronizing the blank with either the pattern glue application 120 or the film applicator 130 for situations in which a film patch is not applied to the blank. The non-synchronized carriers 160 and the synchronized carrier 180 can also be configured to synchronize the blanks with the pattern glue applicator 120 for applying a pattern of glue to the blank and for attaching a film patch to the pattern of glue. In one embodiment, the synchronized carrier 180 is only in the film attaching unit 102 and the non-synchronized carriers 160 are in both the film attaching unit 102 and the fold/glue unit 104. The glue-guns 142, fold-members 144, non-synchronized carriers 160 and the synchronized carrier 180 can be raised/lowered and moved side-to-side (FIG. 2) to configure the film attaching unit 102 and the fold/glue unit 104 for forming different types of blanks into containers. The non-synchronized carriers 160 can be belt-drives known in the art, and the synchronized carrier 180 can be a timed-chain carrier also known in the art. Several embodiments of the non-synchronized carriers 160, the synchronized carrier 180, the pattern glue applicator 120, and the film applicator 130 are described in more detail below with respect to FIGS. 3–5.

The integrated apparatus 100 can form containers having a film patch over an opening by placing a plurality of blanks in the feeder 110 and transporting the blanks through the film attaching unit 102 and the fold/glue unit 104 without removing the blanks from the transport system 106. In one application, for example, a feed carrier defined by the non-synchronized carrier 160 adjacent to the feeder 110 transports a blank to the synchronized carrier 180. The synchronized carrier 180 delivers the blank to the pattern glue applicator 120 in synchronization with the pattern wheel 122 to precisely apply a pattern of glue to the blank (e.g, around the perimeter of an opening). Another non-synchronized carrier 160 at the pattern glue applicator 120 transports the blank with the pattern of glue to the film applicator 130, which applies a film patch to the glue around the opening. Still another non-synchronized carrier 160 immediately downstream from the film applicator 130 engages the blank and initiates the transport of the blank through the fold/glue unit 104. The remaining downstream non-synchronized carriers 160 accordingly transport the blank through the glue guns 142 and the fold-members 144 of the sections 140*a–c* of the fold/glue unit 104 to fold and glue the panels and flaps of the blank together. As set forth in more detail below, the non-synchronized carriers 160 and the synchronized carrier 180 in the film attaching unit 102 of an embodiment of the integrated apparatus 100 can be configured with respect to the pattern glue applicator 120 and the film applicator 130 to: (a) bypass the pattern glue applicator 120 and film applicator 130 for delivering a blank directly from the feeder 110 to the fold/glue unit 104 in applications that do not apply a film patch to the blanks; (b) apply only a pattern of glue to the blank without applying a film patch to the blank; and/or (c) apply both a pattern of glue to the blank and a film patch to the patterned glue on the blank.

One advantage of several embodiments of the integrated apparatus 100 is that it is expected to reduce labor costs and overhead for producing containers with film coverings. Unlike conventional processes that use separate window patch machines and separate fold/glue machines, several embodiments of the integrated apparatus 100 combine the film attaching unit 102 and the fold/glue unit 104 with a single transport system 106. A single operator can accordingly simultaneously run the integrated apparatus 100 to perform both the window attaching and the folding/gluing operations for forming a container with a film patch over an opening in the container. Several embodiments of the integrated apparatus 100 are also expected to reduce the floor space required for producing containers with a thin film patch because a single feeder can provide blanks to both the film attaching unit 102 and the fold/glue unit 104. Additionally, several embodiments of the integrated apparatus 100 provide an efficient use of floor space because they eliminate the need for storing stacks of blanks for processing through a separate fold/glue machine. Therefore, several embodiments of the integrated apparatus 100 are expected to reduce the labor costs and overhead for forming containers with thin film patches over openings.

Another advantage of several embodiments of the integrated apparatus 100 is that they are expected to reduce the processing time for fabricating containers with thin film coverings compared to conventional two-step finishing processes. By transporting the blanks along a single transport system 106 through both the film attaching unit 102 and the fold/glue unit 104, several embodiments of the integrated apparatus 100 eliminate the process of manually transporting the blanks from one machine to another and loading the blanks into a feeder for a separate fold-glue machine. As a result, several embodiments of the integrated apparatus 100 are expected to significantly reduce the processing time for fabricating containers with film patches over openings.

B. SELECTIVELY CONFIGURABLE FILM ATTACHING UNITS

Figure 3:
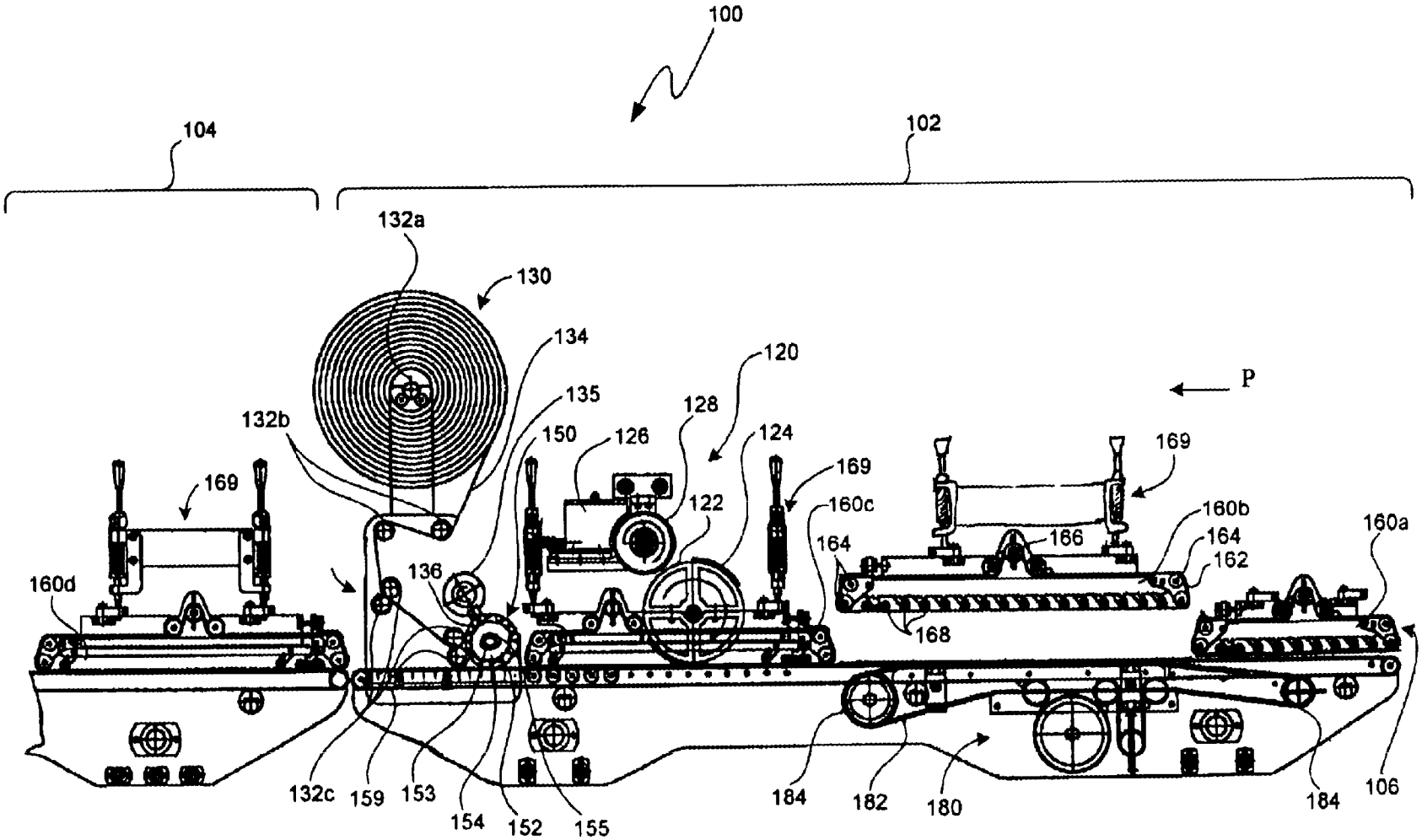
FIG. 3 is a side elevation view illustrating a portion of an integrated apparatus for forming folded containers in accordance with an embodiment of the invention.
Figure 4:
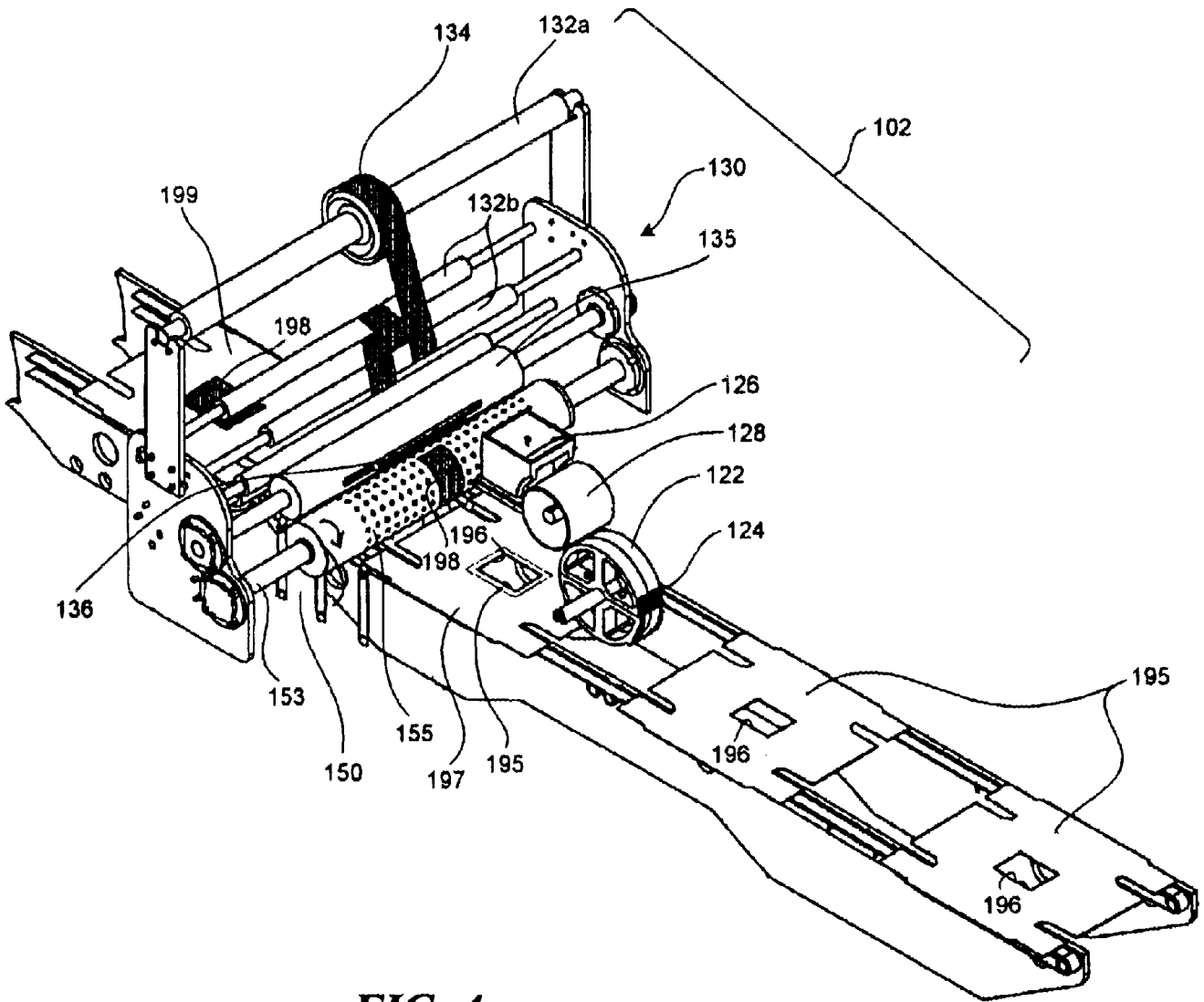
FIG. 4 is an isometric view illustrating a portion of an integrated apparatus for forming folded containers in accordance with an embodiment of the invention.

The integrated apparatus 100 is preferably configurable so that it can process blanks with or without film patches. FIG. 3 is a side elevation view and FIG. 4 is an isometric view partially illustrating an embodiment of the film attaching unit 102 for use in connection with the fold/glue unit 104 in an embodiment of the integrated apparatus 100. Referring to FIG. 3, the non-synchronized carriers 160 in the film attaching unit 102 can comprise a feed carrier 160*a* that receives blanks from the feeder 110 (FIG. 1); a first configurable non-synchronized adjustable carrier 160*b* generally aligned with the synchronized carrier 180; a second configurable non-synchronized carrier 160*c* downstream from the synchronized carrier 180; and a third configurable non-synchronized carrier 160*d* at the beginning of the fold/glue unit 104 immediately downstream from the film applicator 130. The non-synchronized carriers 160 can include a belt 162 wrapped around a plurality of guide rollers 164 with a belt tension roller 166. The non-synchronized carriers 160 can also include a plurality of surface rollers 168 to press the belt 162 against the blanks in the transport system 106. Additionally, the configurable non-synchronized carriers 160*b–d* can have lift assemblies 169 to selectively raise and lowered the carriers 160*b–d* for configuring the operation of the film attaching unit 102.

In operation, the first configurable non-synchronized carrier 160*b* can be positioned in a lowered position (not shown) in which the belt 162 engages a blank in a manner to cause the blank to bypass the synchronized carrier 180. The first configurable non-synchronized carrier 160*b* can also be positioned in a raised position in which the feeder carrier 160*a* delivers a blank to the synchronized carrier 180 for synchronizing the blank with respect to the pattern glue applicator 120 and the film applicator 130. The belts 162, the rollers 164–168, and the lift assemblies 169 are known in the art of non-synchronized belt-type carriers.

The synchronized carrier 180 can have a timed-chain 182 wrapped around a plurality of guide sprockets 184. The timed-chain 182 has a plurality of individual stops (not shown) that are configured to engage a blank and move the blank along the transport system 106 at known intervals. The synchronized carrier 180 can alternatively be a belt feed system similar to feed systems for automatic-feed copiers. As such, the synchronized carrier 180 can be any suitable carrier capable of receiving a blank and advancing the blank along the transport system at selected intervals.

Referring to FIGS. 3 and 4 together, the pattern wheel 122 of the pattern glue unit has a pattern surface 124. The pattern glue unit 120 of this embodiment also has a glue reservoir 126 and a pick-up wheel 128 in contact with glue in the glue reservoir 126. In operation, the reservoir 126 deposits a layer of glue on the pick-up wheel 128, which applies a layer of the glue to the pattern surface 124 on the pattern wheel 122. The pattern surface 124 on the pattern wheel 122 is synchronized with the timed-chain 182 of the synchronized carrier 180 (FIG. 3) so that the pattern surface 124 applies a pattern of glue 195 (FIG. 4) around an opening 196 on a blank 197 (FIG. 4).

The embodiment of the film applicator 130 shown in FIGS. 3 and 4 has a plurality of rollers 132 including a supply roller 132a carrying a roll of film 134, a plurality of idler rollers 132*b* to guide the film 134, and a plurality of drive rollers 132c to advance the film 134. The film applicator 130 can also include a film cutter 135 having a blade 136 and a film applicator assembly 150. As best shown in FIG. 3, the film applicator assembly 150 includes a perforated cylinder 152 that rotates about a shaft 153 having a blow-off section 154 and a vacuum section 155. In operation, the vacuum section 155 of the shaft 153 draws a vacuum around a majority of the circumference of the perforated cylinder 152 to hold the film 134 against the perforated cylinder 152. The cutting blade 136 of the film cutter 135 cuts a film patch 198 (FIG. 4) from the section of the film 134 held on the perforated cylinder 152 by the vacuum section 155. As a leading edge of the film patch 198 moves under the shaft 153, a blank 197 with a pattern glue 195 around an opening 196 is accordingly positioned under the perforated cylinder 152 in a synchronized manner so that the leading edge of the film patch 198 presses against the leading edge of the patterned glue 195. The blow-off portion 154 of the shaft 153 drives the film patch 198 from the perforated cylinder 152 in synchronization with pressing the film patch 198 against the pattern glue 195 on the blank 197. A blank 199 to which a film patch 198 has been attached accordingly exits the film applicator 130 and is transported by the third configurable non-synchronized carrier 160*d* (FIG. 3) to the pre-fold section 140*a* (FIG. 1).

Figure 5:
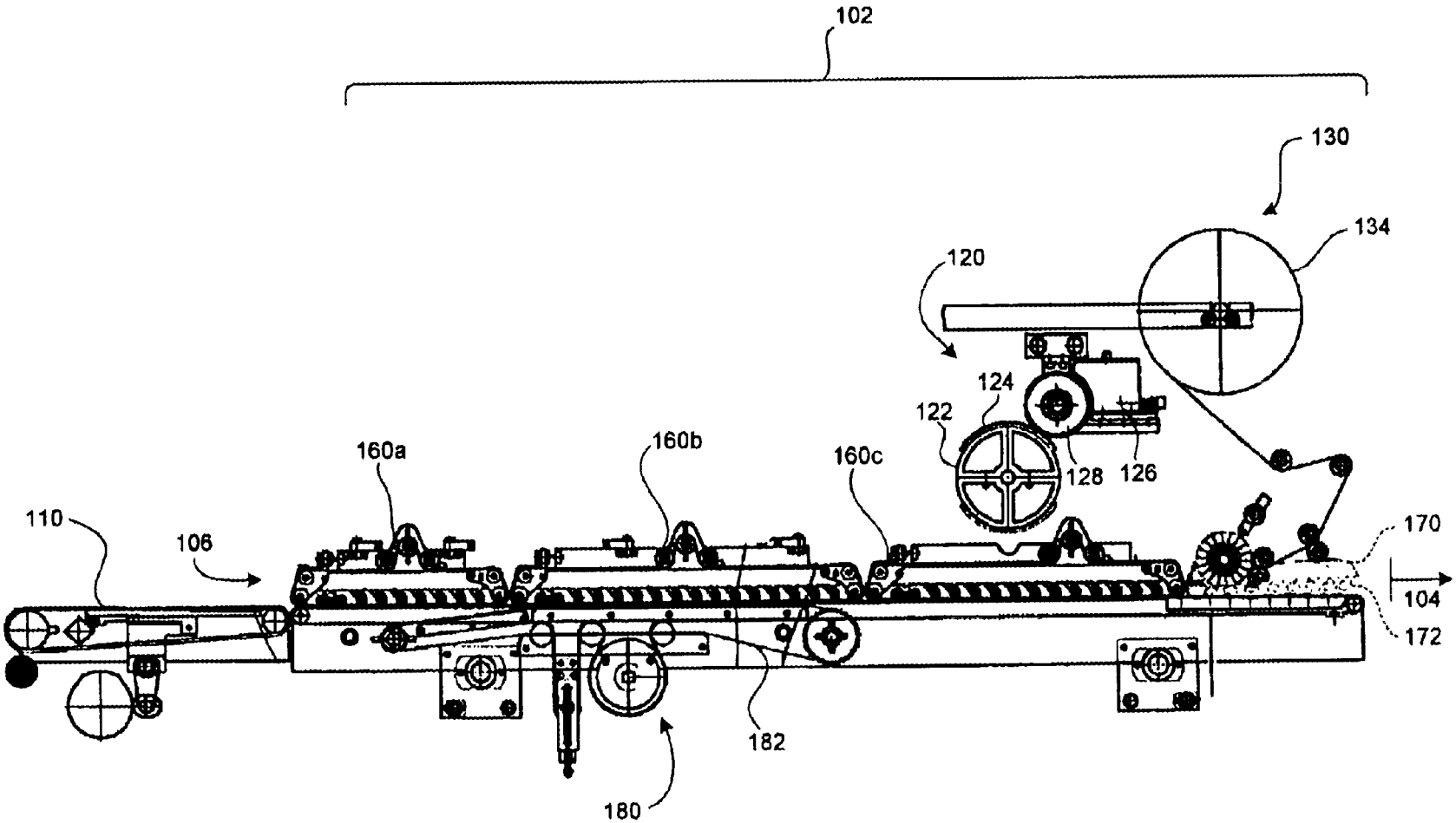
FIG. 5 is a side elevation view illustrating a portion of an integrated apparatus for forming folded containers in accordance with an embodiment of the invention.

FIG. 5 is a side elevation view of the film attaching unit 102 shown in FIGS. 3 and 4 from an opposite side such that the processing path P goes from left-to-right. In this configuration, the first configurable non-synchronized carrier 160*b* is in the lowered or bypass position in which it carries a blank past the synchronized carrier 180. Additionally, the pattern glue applicator 120 and the film applicator 130 are in raised positions in which they cannot apply a pattern of glue or a film patch to a blank. In one embodiment of the bypass configuration or the pattern glue only configuration, the transport system 106 can also include a non-synchronized bearing unit 170 between 160*c* and 160*d*. The non-synchronized bearing unit 170 has a plurality of bearing 172. In operation the non-synchronized bearing unit 170 is lowered and the film applicator 130 is raised when the film application unit 120 does not attach a film patch to the blank. The non-synchronized bearing unit 170 is raised and the film applicator 130 is lowered to apply a film patch to the blank. FIG. 5 accordingly illustrates a configuration of the film attaching unit 102 in which the non-synchronized carriers 160*a–c* pass a blank through the film attaching unit 102 without either applying a glue pattern to the blank or attaching a film patch to the blank.

Referring to FIGS. 3 and 5, the film attaching unit 102 can accordingly be configured into (a) a bypass configuration, (b) a pattern glue configuration, and/or (c) a film application configuration. FIG. 5 illustrates the transport system 106 with the non-synchronized carriers 160*a–c*, the synchronized carrier 180, the pattern glue applicator 120, and the film applicator 130 positioned to allow the blank to bypass the pattern glue applicator 120 and the film applicator 130. This configuration is typically used in applications that do not apply a pattern of glue or a film patch to a container, such as containers that do not include windows. Referring to FIG.

3, the first configurable non-synchronized carrier 160*b* is raised so that a blank is controlled by the synchronized carrier 180 to synchronize the blank with the pattern glue applicator 120. In this configuration, the pattern glue applicator 120 can apply a pattern of glue to the blank and the film applicator 130 can apply a film patch to the pattern of glue, or the pattern glue applicator 120 can apply a pattern of glue to the blank and the film applicator 130 can be in a raised position (not shown in FIG. 3) so that a film patch is not applied to the pattern of glue.

One advantage of the embodiment of the film attaching unit 102 shown in FIGS. 3–5 is that the transport system 106 can be configured to allow the integrated apparatus 100 to form either (a) a container with a film patch, (b) a container with a particular glue pattern that cannot be achieved with glue guns in the fold/glue unit 104, or (c) a container without a film patch. The integrated apparatus 100, therefore, is not limited to producing only containers that have transparent films, but it can also be used to produce other types of containers without transparent film patches. As a result, the integrated apparatus 100 provides a flexible machine that can be selectively configured to produce virtually any type of container, with or without film patches, in single-run processing.

From the foregoing, it will be appreciated that although specific embodiments of the invention have been described herein for purposes of illustration, various modifications may be made without deviating from the spirit and scope of the invention. For example, the pattern glue unit 102 can be a different type of mechanism that is capable of being synchronized with the blanks and depositing a pattern of glue. The synchronized carrier 180 can also be a different mechanism, or it can even be eliminated by substituting an optical timing system to activate and synchronize the pattern glue applicator 120 with the blank. Other embodiments can also have different types of fold/glue units with different configurations of sections. Accordingly, the invention is not limited except as by the appended claims.

What is claimed is:

1. An integrated apparatus for forming folded containers, comprising:

a film attaching unit having a pattern glue applicator for applying a pattern of glue to a blank and a film applicator operatively coupled to the pattern glue applicator to apply a film to the blank;

a fold/glue unit configured to receive the blank directly from the film attaching unit, the fold/glue unit having a plurality of fold-members for folding portions of the blank and at least one glue gun for applying glue to portions of the blank;

a blank transport system having a synchronized carrier to transport the blank through a portion of the film attaching unit and a plurality of non-synchronized carriers to transport the blank through the film attaching unit and/or the fold/glue unit without removing the blank from the transport system;

wherein the pattern glue applicator comprises a glue reservoir, a pick-up wheel positioned in a portion of the glue reservoir to pick up a layer of glue, and a pattern wheel having a pattern surface corresponding to a desired glue pattern, the pattern surface contacting the pick-up wheel to coat the pattern surface with glue;

wherein the film applicator comprises a film carrier, a film applicator assembly having a vacuum section and a blow-off section, and a film cutter, wherein the film cutter cuts a section of the film on the film applicator assembly, the vacuum section of the film applicator assembly holds the cut section of the film until a leading edge of the film is pressed against the pattern glue on the blank, and the blow-off section detaches the cut section of film from the film applicator assembly; and wherein the transport system further comprises at least a first non-synchronized carrier in the film attaching unit aligned with the synchronized carrier, a second non-synchronized carrier downstream from the synchronized carrier and in the region of the pattern glue applicator, and a plurality of non-synchronized carriers downstream from the film applicator in the fold/glue unit, the first non-synchronized carrier and the synchronized carrier moving between a non-timed configuration in which the non-synchronized carrier moves the blank and a timed configuration in which the synchronized carrier moves the blank to the pattern glue machine.

2. An integrated apparatus for forming folded containers, comprising:

a film attaching unit having a pattern glue applicator for applying a pattern of glue to a blank and a film applicator operatively coupled to the pattern glue applicator to apply a film to the blank;

a fold/glue unit configured to receive the blank directly from the film attaching unit, the fold/glue unit having a plurality of fold-members for folding portions of the blank and at least one glue gun for applying glue to portions of the blank;

a blank transport system having a synchronized carrier to transport the blank through a portion of the film attaching unit and a plurality of non-synchronized carriers to transport the blank through the film attaching unit and/or the fold/glue unit without removing the blank from the transport system;

at least a first non-synchronized carrier in the film attaching unit generally aligned with the synchronized carrier, the first non-synchronized carrier being a belt-carrier movable between a bypass position in which the first non-synchronized carrier transports the blank past the synchronized carrier without synchronizing the blank with the pattern glue applicator;

a second non-synchronized carrier downstream from the synchronized carrier and in the region of the pattern glue applicator, the second non-synchronized carrier receiving the blank from either (a) the synchronized carrier for applying a pattern glue onto the blank or (b) the first non-synchronized carrier for passing the blank through the pattern glue applicator without applying a pattern of glue to the blank; and a plurality of non-synchronized carriers downstream from the film applicator in the fold/glue unit.

3. An integrated apparatus for forming folded containers, comprising:

a film attaching unit having a pattern glue applicator for applying a pattern of glue to a blank and a film applicator operatively coupled to the pattern glue applicator to apply a film to the blank;

a fold/glue unit configured to receive the blank directly from the film attaching unit, the fold/glue unit having a plurality of fold-members for folding portions of the blank and at least one glue gun for applying glue to portions of the blank;

a blank transport system having a synchronized carrier to transport the blank through a portion of the film attaching unit and a plurality of non-synchronized carriers to transport the blank through the film attaching unit and/or the fold/glue unit without removing the blank from the transport system;

a single feeder upstream from the film attaching unit, the single feeder providing blanks to the film attaching unit that are subsequently transported by the transport system to the fold/glue unit; and a first set of belt carriers including a feed belt carrier immediately downstream from the feeder and a first configurable belt carrier, the feed belt carrier and the first configurable belt carrier being over the synchronized carrier, and the first configurable belt carrier being moveable into (a) a bypass position to carry a blank past the synchronized carrier for bypassing the pattern glue applicator and the film applicator and (b) a synchronized position to feed the blank to the synchronized carrier for processing the blank through the pattern glue applicator and/or the film applicator.

* * * * *

UNITED STATES PATENT AND TRADEMARK OFFICE

CERTIFICATE OF CORRECTION

PATENT NO. : 6,656,100 B1
DATED : December 2, 2003
INVENTOR(S) : Whah Tseng

It is certified that error appears in the above-identified patent and that said Letters Patent is hereby corrected as shown below:

Column 3,
Line 52, “application” should be -- applicator --;

Signed and Sealed this

Twenty-second Day of June, 2004

JON W. DUDAS
*Acting Director of the United States Patent and Trademark Office*